US006363538B1

(12) United States Patent
Davis

(10) Patent No.: US 6,363,538 B1
(45) Date of Patent: Apr. 2, 2002

(54) STRETCH POCKET

(76) Inventor: Lori Davis, 8637 Twin Lakes Blvd., Tampa, FL (US) 33614

( * ) Notice: Subject to any disclaimer, the term of this patent is extended or adjusted under 35 U.S.C. 154(b) by 0 days.

(21) Appl. No.: 09/591,370

(22) Filed: Jun. 9, 2000

(51) Int. Cl.[7] ..... A41D 27/20
(52) U.S. Cl. ..... 2/247; 2/238; 2/94
(58) Field of Search ..... 2/247–251, 243.1, 2/94, 227, 228, 238, 115; 112/413

(56) References Cited

U.S. PATENT DOCUMENTS 3,775,960 A * 12/1973 Ogawa et al. ..... 112/413
4,365,355 A * 12/1982 Off et al. ..... 2/247
4,549,916 A * 10/1985 Off et al. ..... 156/93
4,791,681 A * 12/1988 Dean ..... 2/106
5,361,412 A * 11/1994 Perry ..... 2/69
5,419,161 A * 5/1995 Bodenschatz et al. .... 66/172 E
5,634,215 A * 6/1997 DeBeane ..... 2/227
5,724,679 A * 3/1998 Hans ..... 2/238
6,041,441 A * 3/2000 Counts et al. ..... 2/227

* cited by examiner

*Primary Examiner*—John J. Calvert
*Assistant Examiner*—Tejash Patel
(74) *Attorney, Agent, or Firm*—Holland & Knight LLP

(57) ABSTRACT

A pair of shorts having an expandable pocket where both the shorts and the pocket are made of a stretchable material. The expandable pocket has opposing seams that comprise the opposing seams of the pair of shorts. The pocket further has a transverse seam at the lower end of the pocket positioned across the opposing seams of the pocket and the opposing seams of the pair of shorts. The transverse seam comprises an expandable stitch, whereby, the lower end of the pocket may expand in conjunction with the opposing seams of the pocket and the opposing seams of the pair of shorts, thereby providing an expandable and durable pocket for the pair of shorts.

13 Claims, 8 Drawing Sheets

STRETCH POCKET

BACKGROUND OF THE INVENTION

1. Field of the Invention

The present invention relates to an article of wearing apparel, and more particularly to a pocket for carrying items.

2. Description of the Background Art

It is well known that pockets on clothing are useful for carrying items such as medicines, keys, money, sunglasses, tools, etc. Pockets have been attached to several articles of clothing, such as pants, shorts, shirts, dresses, overalls, coats, etc.

Various pocket designs are shown in the prior art which are useful for a variety of purposes, the pocket configuration being designed around the particular area of interest. These attempts have not been able to provide a pocket that is as durable as that of the present invention.

For instance, U.S. Pat. No. 4,332,034 entitled "Garment Waistband Structures" discloses a trousers waistband structure employing a two-part elastic band with an elastic reinforcement strip attached to the two-part elastic band such that the lower linear edge of the reinforcement strip depends freely from the band.

U.S. Pat. No. 4,384,369 entitled "Exercise Suit" discloses an exercise suit which includes a jacket and pants having numerous pockets. To permit automatic adjustment for different body sizes, the sleeves and legs of the suit are longitudinally slit and an elastic strap draws the opposite edges of each slit toward one another thus maintaining the suit and its dynamic load in proximate contact with the user's limits.

U.S. Pat. No. 4,811,427 entitled "Athletic Garment or Protecting Genital Area" discloses an athletic garment particularly suitable for hockey players protects the genital area of the wearer. The garment comprises a waistband which is supported at the wearer's waist elastically and with a drawstring.

U.S. Pat. No. 5,014,356 entitled "Dropseat Jumpsuit" discloses a jumpsuit with an improved, utilitarian dropseat having a bodice attached to pants at the front waist seam. The pants have hidden, in-seam side pockets that facilitate the opening of the dropseat area.

U.S. Pat. No. 5,134,726 entitled "Sports Pants with Protective Pads" discloses a sports pant with protective pads including a trunk and legs formed of elastically stretchable material with pockets in at least the hip and knee areas, and legs terminating in stirrup ends.

None of the above-identified patents teach the combination of structural elements disclosed and claimed herein which cooperate in a unique manner to provide a pocket for an article of clothing that has increased durability and can be easily manufactured.

It would, therefore, be advantageous to have a pocket that can be incorporated into the seams of the article of clothing thereby providing increased strength and durability to the pocket. Also, the pocket could be easily attached to the article of clothing during manufacturing since the pocket would be joined at the seam of the article of clothing thereby reducing the costs of manufacturing.

It would also be advantageous to have a pocket that allows for easy, convenient retrieval of items, particularly while performing athletic activities.

Therefore, it is an object of this invention to provide an improvement which overcomes the aforementioned inadequacies of the prior art and provides an improvement which is a significant contribution to the advancement of the art of pockets.

Accordingly, what is needed in the art is a pocket which is attached to an article clothing by opposing longitudinal seams.

Another object of the present invention is to increase the strength of the pocket.

Yet another object of the present invention is to provide an improved pocket which can be attached to different articles of clothing.

Still yet another object of the present invention is to provide a pocket that can be easily accessed by the wearer of the article of clothing.

Another object of the present invention is to provide an improved pocket that allows the longitudinal seams of the pocket to expand in conjunction with the longitudinal seams of the article of clothing.

Yet another object of the present invention is to provide a pocket which employs a transverse seam across the lower end of the pocket between a pair of opposing seams.

Another object of the present invention is to provide a pocket that employs a serge stitch as a transverse seam across the lower end of the pocket between a pair of opposing seams.

Still yet another object of the present invention is to provide a pocket for an article of clothing comprising a pair of opposing seams on the article of clothing, the opposing seams of the pocket attaching to the opposing seams of the article of clothing, and the pocket further having a transverse seam positioned across the opposing seams of the pocket and the opposing seams of the article of clothing, the transverse seam comprising an expandable stitch, whereby, the pocket may expand as the opposing seams of the pocket and the opposing seams of the article of clothing expand, thereby providing an expandable and durable pocket for the article of clothing.

Another object of the present invention is to provide a pocket for an article of clothing that comprises at least one front panel having a first end and a second end, at least one back panel having a first end and a second end, at least one pocket having a first end and a second end and a lower end, a first longitudinal seam along the first end of the front panel, along the first end of the back panel, and along the first end of the pocket, a second longitudinal seam along the second end of the front panel, along the second end of the back panel, and along the second end of the pocket, and the pocket further having a transverse seam at the lower end of the pocket positioned between the first longitudinal seam and the second longitudinal seam, the transverse seam comprising an expandable stitch, whereby, the lower end of the pocket can expand in conjunction with the first longitudinal seam and the second longitudinal seam, thereby providing an expandable and durable pocket for the article of clothing.

Yet another object of the present invention is to provide a pocket for a pair of shorts that comprises a plurality of seams comprising in combination a waistband, a front left panel having a left edge portion and a right edge portion extending downwardly from the waistband, an inner front right panel having a left edge portion and a right edge portion extending downwardly from the waistband an outer front right panel having a left edge portion and a right edge portion extending downwardly from the waistband, a back left panel having a left edge portion and a right edge portion extending downwardly from the waistband, a back right panel having a left edge portion and a right edge portion extending downwardly from the waistband, at least one pocket having a left edge portion, a right edge portion, an upper end and a lower end, an outer left seam along the left edge portion of the front left panel and along the left edge portion of the back left panel, an inseam along the right edge portion of the front left panel, along the left edge portion of the inner front right panel, along the right edge portion of the back left panel and along the left edge portion of the back right panel, an inner front right seem along the right edge portion of the inner front right panel, along the left edge portion of the outer front right panel and along the left edge portion of the pocket, an outer right seam along the right edge portion of the outer front right panel, along the right edge portion of the back right panel and along the right edge portion of the pocket, and the pocket further having a transverse seam positioned at the lower end of the pocket from the left edge portion of the pocket to the right edge portion of the pocket and from the left edge portion of the outer front right panel to the right edge portion of the outer front right panel, the transverse seam comprising an expandable stitch, whereby, the lower end of the pocket can expand in conjunction with the inner front right seam and the outer right seam, thereby providing an expandable and durable pocket for the pair of shorts.

Another object of the present invention is to provide an article of clothing having at least one longitudinal seam comprising in combination a pocket having a longitudinal seam, the longitudinal seam of the pocket comprising the longitudinal seam of the article of clothing, and the pocket further having a transverse seam along the pocket, the transverse seam comprising an expandable stitch, whereby, the pocket may expand as the longitudinal seam of the pocket and the longitudinal seam of the article of clothing expand, thereby providing an expandable and durable pocket for the article of clothing.

The foregoing has outlined some of the pertinent objects of the present invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

In accordance with the present invention, there is provided an expandable and durable pocket for an article of clothing.

In one preferred embodiment of the present invention, the expandable pocket structure for an article of clothing comprises a pair of opposing seams on the article of clothing where the opposing seams of the pocket attach to the opposing seams of the article of clothing. In addition, the pocket further has a transverse seam positioned across the opposing seams of the pocket and the opposing seams of the article of clothing. The transverse seam comprises an expandable stitch, whereby, the pocket may expand as the opposing seams of the pocket and the opposing seams of the article of clothing expand, thereby providing an expandable and durable pocket for the article of clothing.

In another preferred embodiment of the present invention, the expandable pocket structure for an article of clothing comprises a plurality of longitudinal seams. There is at least one front panel which has a first end and a second end, and at least one back panel which has a first end and a second end. There is at least one pocket which has a first end and a second end and a lower end. A first longitudinal seam is provided along the first end of the front panel, along the first end of the back panel, and along the first end of the pocket. A second longitudinal seam is provided along the second end of the front panel, along the second end of the back panel, and along the second end of the pocket. In addition, the pocket further has a transverse seam at the lower end of the pocket positioned between the first longitudinal seem and the second longitudinal seam. The transverse seam comprises an expandable stitch, whereby, the lower end of the pocket can expand in conjunction with the first longitudinal seam and the second longitudinal seam.

In yet another preferred embodiment of the present invention, the expandable pocket structure is attached to a pair of shorts. The shorts have a waistband, a front left panel which has a left edge portion and a right edge portion extending downwardly from the waistband, an inner front right panel which has a left edge portion and a right edge portion extending downwardly from the waistband, an outer front right panel which has a left edge portion and a right edge portion extending downwardly from the waistband, a back left panel which has a left edge portion and a right edge portion extending downwardly from the waistband, a back right panel which has a left edge portion and a right edge portion extending downwardly from the waistband. There is at least one pocket which has a left edge portion, a right edge portion, an upper end and a lower end. An outer left seam is provided along the left edge portion of the front left panel and along the left edge portion of the back left panel. An inseam is provided along the right edge portion of the front left panel, along the left edge portion of the inner front right panel, along the right edge portion of the back left panel and along the left edge portion of the back right panel. An inner front right seem is provided along the right edge portion of the inner front right panel, along the left edge portion of the outer front right panel and along the left edge portion of the pocket. An outer right seam is provided along the right edge portion of the outer front right panel, along the right edge portion of the back right panel and along the right edge portion of the pocket. In addition, the pocket further has a transverse seam positioned at the lower end of the pocket from the left edge portion of the pocket to the right edge portion of the pocket and from the left edge portion of the outer front right panel to the right edge portion of the outer front right panel. The transverse seam comprises an expandable stitch, whereby, the lower end of the pocket can expand in conjunction with the inner front right seam and the outer right seam.

In another preferred embodiment of the present invention, the expandable pocket structure for an article of clothing comprises at least one longitudinal seam comprising a pocket and a longitudinal seam in the article of clothing. The pocket has a first end and a second end which comprise the longitudinal seam of the article of clothing. In addition, the pocket further has a transverse seam along the pocket. The transverse seam comprises an expandable stitch, whereby, the pocket may expand as the ends of the pocket and the longitudinal seam of the article of clothing expand.

The expandable pocket of the present invention comprises a pair of opposing longitudinal seams that are a part of the article of clothing which are use to integrate the pocket to the article of clothing.

Another feature of the present invention is the increase in strength of the pocket due to the attachment of the opposing longitudinal seams of the pocket to the opposing longitudinal seams of the article of clothing.

Yet another feature of the present invention is the ability to attach the expandable pocket to different articles of clothing.

Another feature of the present invention is the reduced cost in manufacturing due to the ability to easily attach the expandable pocket to different articles of clothing.

Still another feature of the present invention is the ability of the person wearing the article of clothing to easily access the pocket of the present invention.

Another feature of the present invention is the ability of the longitudinal seams of the pocket to expand in conjunction with the longitudinal seams of the article of clothing.

Yet another feature of the present invention is a transverse seam across the lower end of the pocket allowing the lower end of the pocket to expand in conjunction with both the longitudinal seams of the article of clothing and the longitudinal seams of the pocket.

Still another feature of the present invention is that the pocket employs a serge stitch as a transverse seam across the lower end of the pocket between a pair of opposing seams allowing the pocket to easily expand.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The invention will become more readily apparent from the following description of preferred embodiments thereof shown, by way of example only, in the accompanying drawings wherein.

Similar reference characters refer to similar parts throughout the several views of the drawings.

DETAILED DESCRIPTION OF THE INVENTION

Reference will now be made to the drawings, wherein numeral 10 designates several different articles of clothing, including, but not limited to, a pair of shorts, a pair of pants, a shirt, a dress, a blouse, a vest, a coat, and a jacket in accordance with the present invention.

Figure 1:
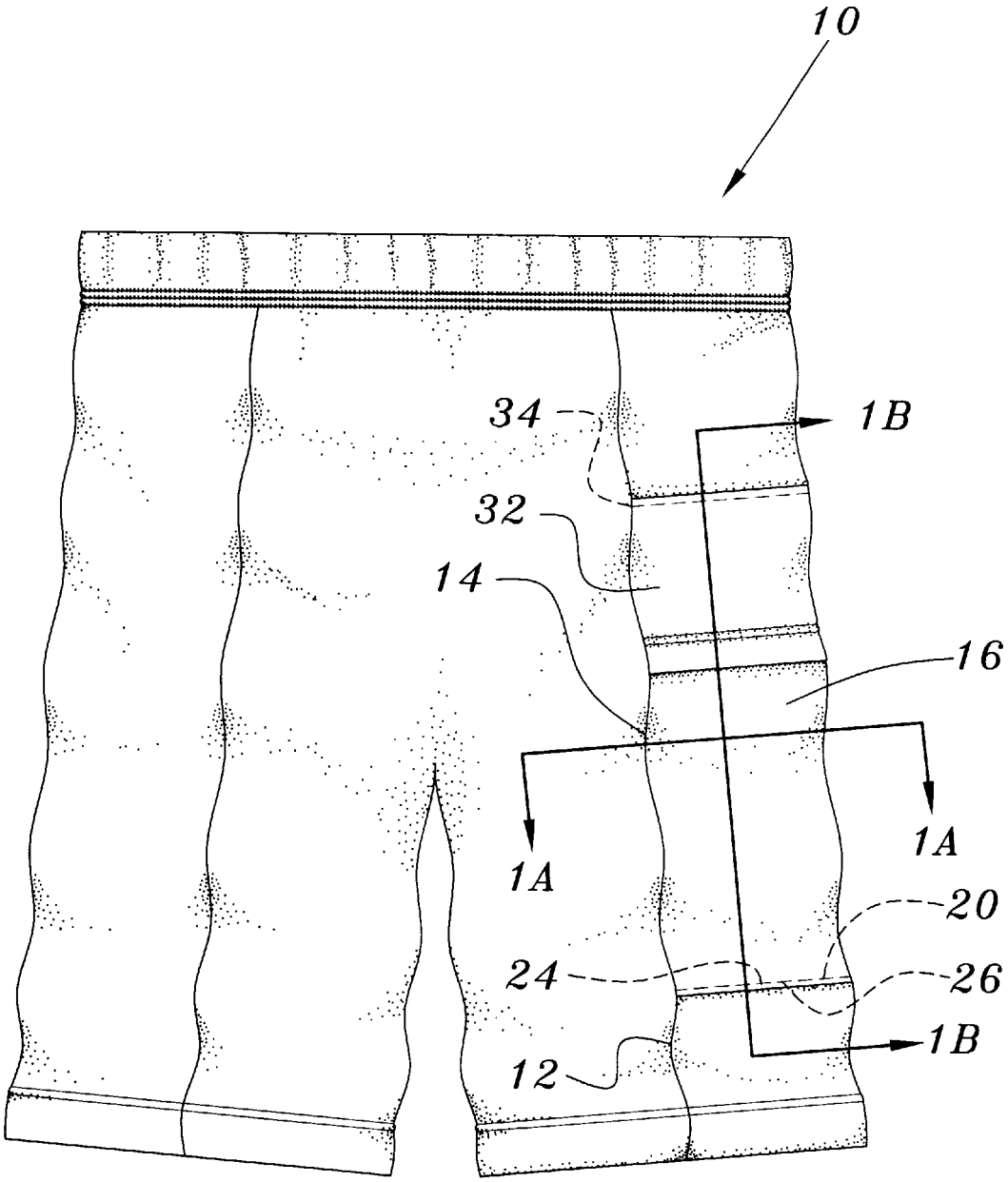
FIG. 1 is a front elevational view of the article of clothing according to a preferred embodiment of the present invention.

Referring now to FIG. 1, there is shown a front elevational view of the article of clothing 10 according to the present invention. As can be seen, the article of clothing 10 is a pair of shorts. In this preferred embodiment of the present invention, the expandable pocket structure for an article of clothing 10 comprises a pair of opposing seams 12 on the article of clothing 10 where the opposing seams 14 of the pocket 16 attach and/or overlay the opposing seams 12 of the article of clothing 10.

In addition, the pocket 16 further has a transverse seam 20 positioned across the opposing seams 14 of the pocket 16 and the opposing seams 12 of the article of clothing 10. The transverse seam 20 comprises an expandable stitch 24, whereby, the pocket 16 may expand as the opposing seams 14 of the pocket 16 and the opposing seams 12 of the article of clothing 10 expand, thereby providing an expandable and durable pocket 16 for the article of clothing 10.

The article of clothing 10 and the pocket can comprise a variety of materials as will be understood by those with skill in the art. For example, the material can be a lightweight durable fabric such as nylon or polyester. The fabric can be a stretchable material such as a spandex combination fabric to provide a form fit for activities such as biking. Other materials such as Supplex (trade name for nylon fabric by DuPont) are also suitable.

The expandable stitch 24 can comprise several known types of stitches which allow the pocket 16 to expand away from the article of clothing 10. One such stitch is known as a serge stitch 26 which allows the necessary expansion of the pocket 16 along the transverse seam 20.

As shown in FIG. 1, another option for the pocket 16 of the present invention, is the addition of a pocket cover 32 to ensure that items do not fall out of the pocket 16. Further, the pocket cover 16 can have a transverse seam 34 positioned across the opposing seams 12 of the article of clothing 10 and the opposing seams 14 of said pocket 16.

Figure 1A:
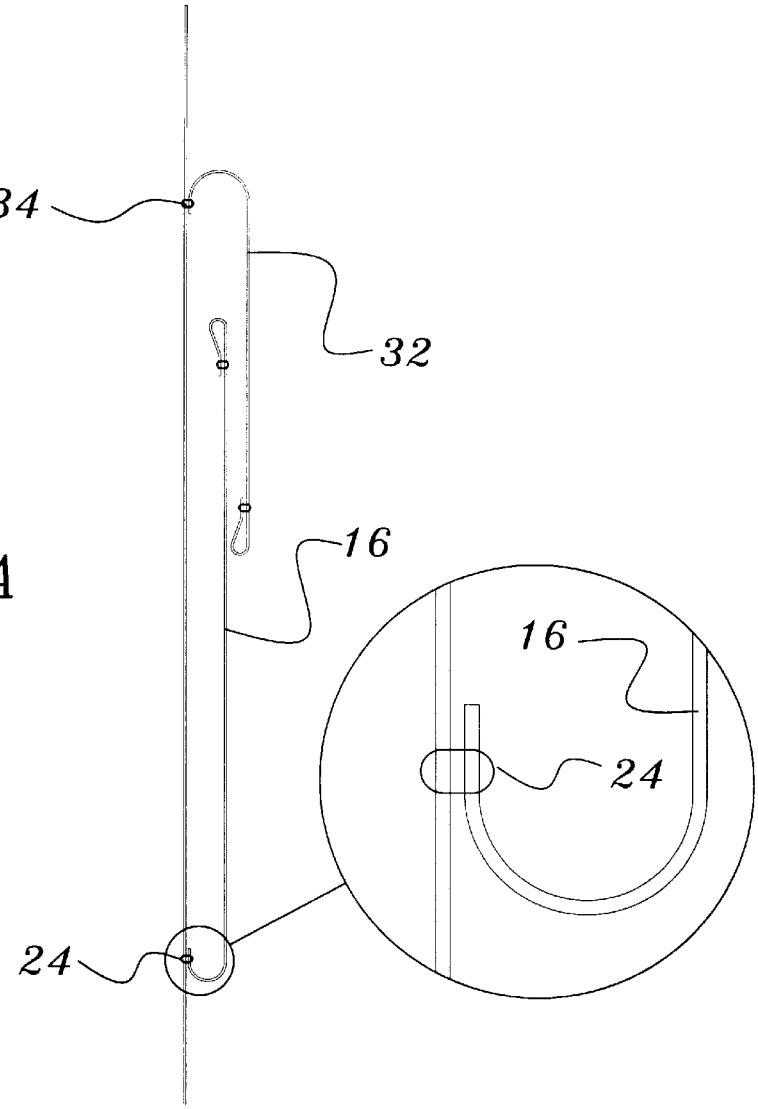
FIG. 1A is a cross sectional view of the pocket along line 1A—1A of FIG. 1 according to the present invention.

As best shown in FIG. 1A, a cross sectional view of the pocket along line 1A—1A of FIG. 1, the pocket cover 32 is placed over the front of the pocket 16.

Figure 1B:
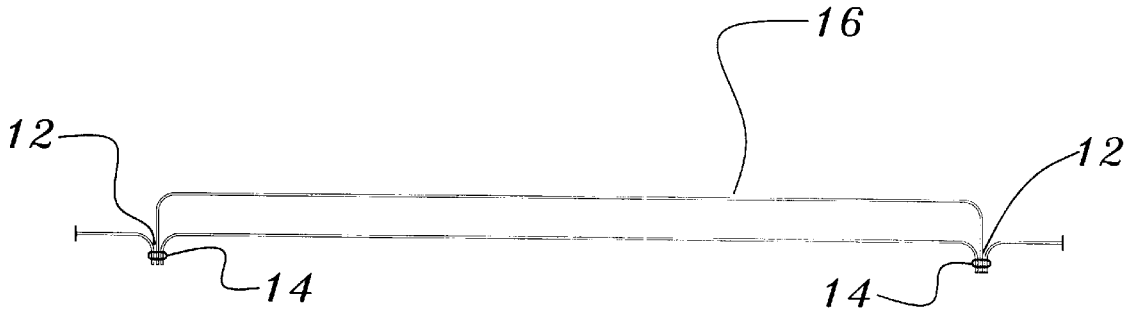
FIG. 1B is a cross sectional view of the pocket along line 1B—1B of FIG. 1 according to the present invention.

As best shown in FIG. 1B, a cross sectional view of the pocket along line 1B—1B of FIG. 1, the opposing seams 14 of the pocket 16 and the opposing seams 12 of the article of clothing 10 are shown joined together.

Figure 2:
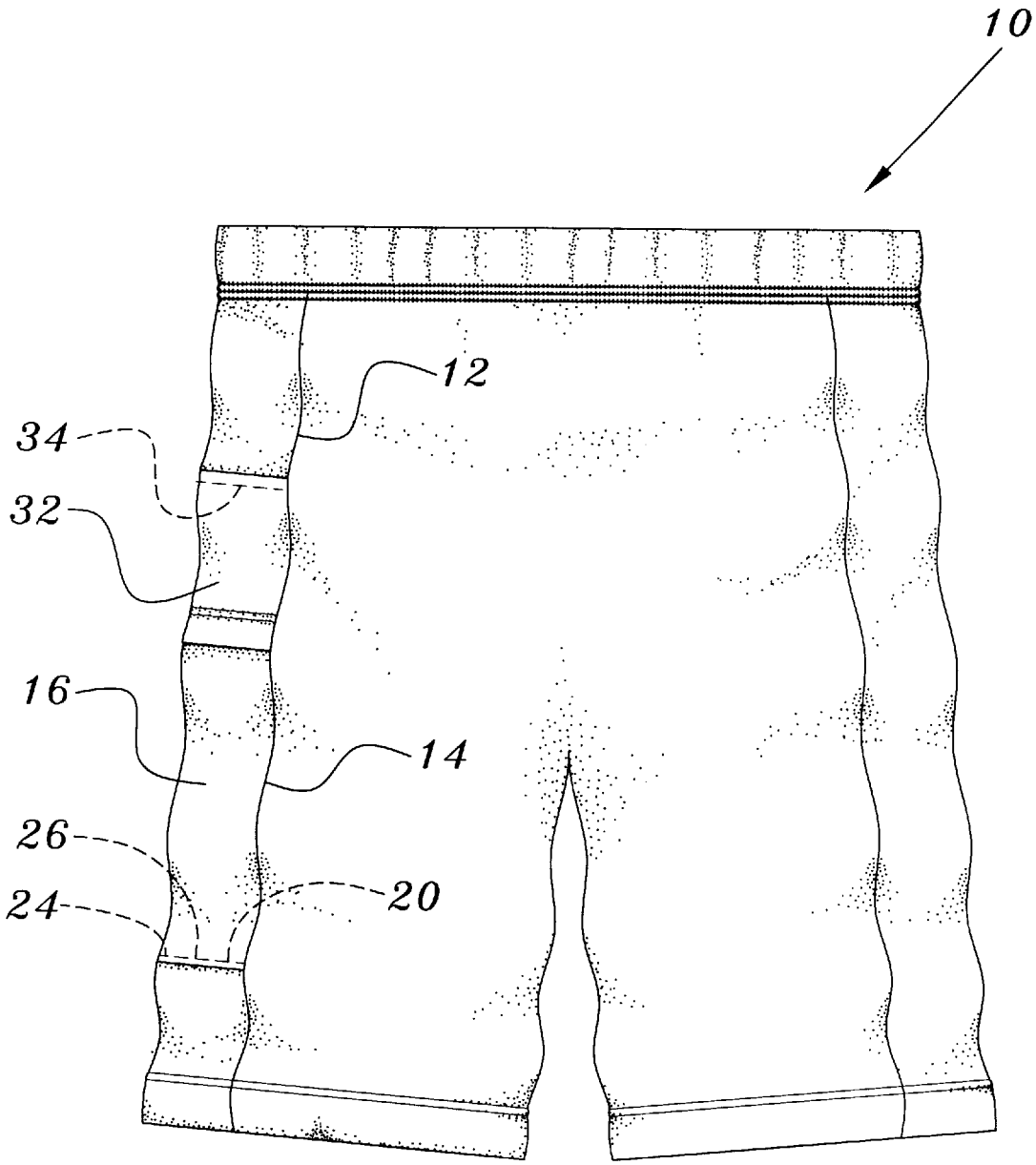
FIG. 2 is a front elevational view of the article of clothing according to another preferred embodiment of the present invention.

In another preferred embodiment of the present invention, as best shown in FIG. 2, the expandable pocket structure for an article of clothing 10 comprises a pair of opposing seams 12 on the article of clothing 10 where the opposing seams 14 of the pocket 16 attach and/or overlay the opposing seams 12 of the article of clothing 10. Further, the pocket 16 has a transverse seam 20 positioned across the opposing seams 14 of the pocket 16 and the opposing seams 12 of the article of clothing 10. The transverse seam 20 comprises an expandable stitch 24, whereby, the pocket 16 may expand as the opposing seams 14 of the pocket 16 and the opposing seams 12 of the article of clothing 10 expand, thereby providing an expandable and durable pocket 16 for the article of clothing 10.

As shown in FIG. 2, a pocket cover 32 is provided. Further, the pocket cover 16 can have a transverse seam 34 positioned across the opposing seams 12 of the article of clothing 10 and the opposing seams 14 of said pocket 16.

Figure 3:
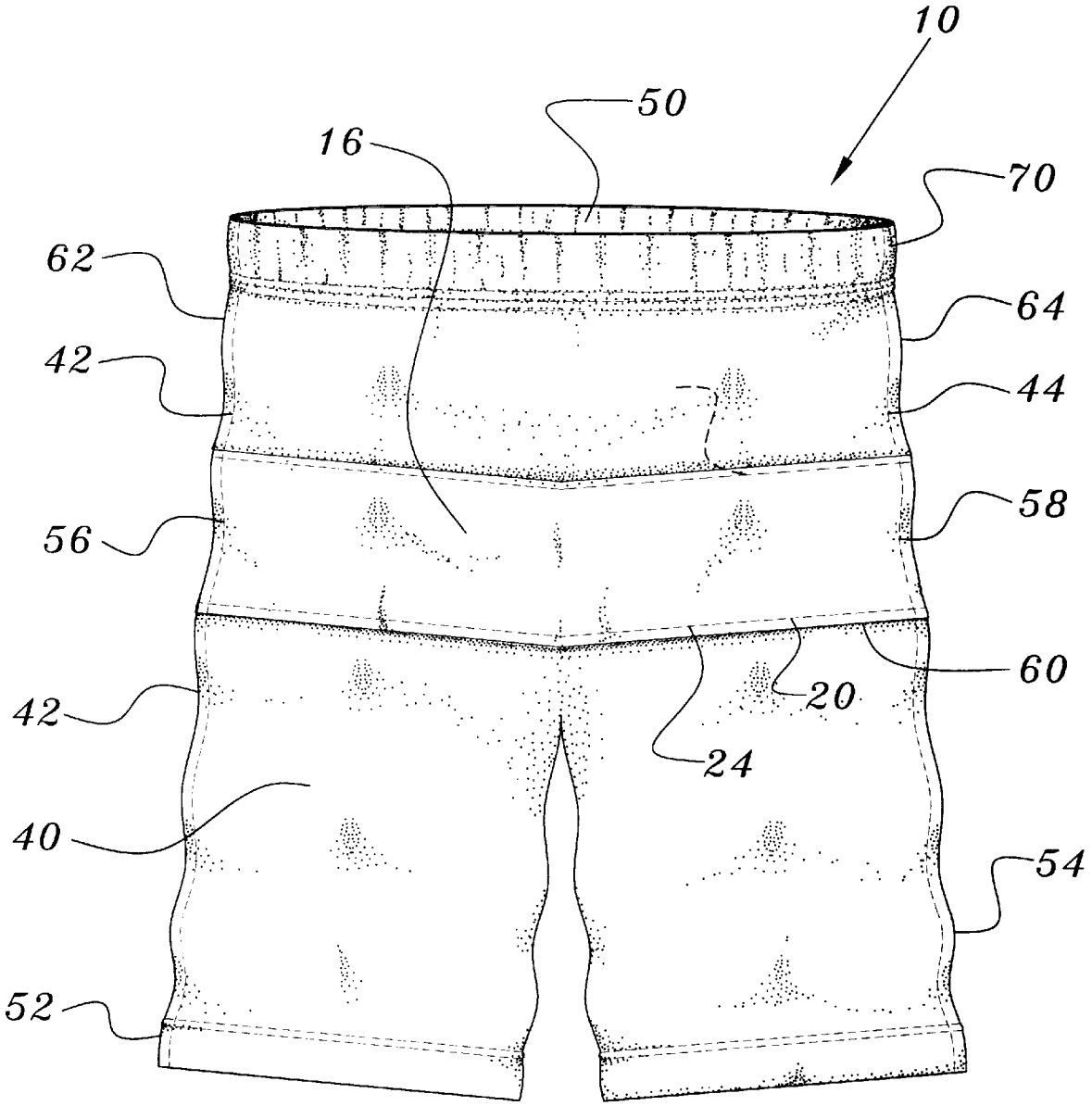
FIG. 3 is a front elevational view of the article of clothing according to another preferred embodiment of the present invention.

In another preferred embodiment of the present invention, the expandable pocket structure for an article of clothing 10 comprises a plurality of longitudinal seams. As best shown in FIG. 3, there is at least one front panel 40 which has a first end 42 and a second end 44, at least one back panel 50 which has a first end 52 and a second end 54. There is at least one pocket 16 which has a first end 56, a second end 58 and a lower end 60. A first longitudinal seam 62 is provided along the first end 42 of the front panel 40, along the first end 52 of the back panel 50 and along the first end 56 of the pocket 16. A second longitudinal seam 64 is provided along the second end 44 of the front panel 40, along the second end 54 of the back panel 50 and along the second end 58 of the pocket 16.

In addition, the pocket 16 further has a transverse seam 20 at the lower end 60 of the pocket 16 positioned between the first longitudinal seam 62 and the second longitudinal seam 64. The transverse seam 20 comprises an expandable stitch 24, whereby, the lower end 60 of the pocket 16 can expand in conjunction with the first longitudinal seam 62 and the second longitudinal seam 64. The expandable stitch 24 can comprise several known types of stitches which allow the pocket 16 to expand away from the article of clothing 10. One such stitch is known as a serge stitch 26 which allows the necessary expansion of the pocket 16 along the transverse seam 20.

Another feature that can be added to the article of clothing of the present invention is a waistband 70 that employs a drawstring or has an elastic band.

Figure 4:
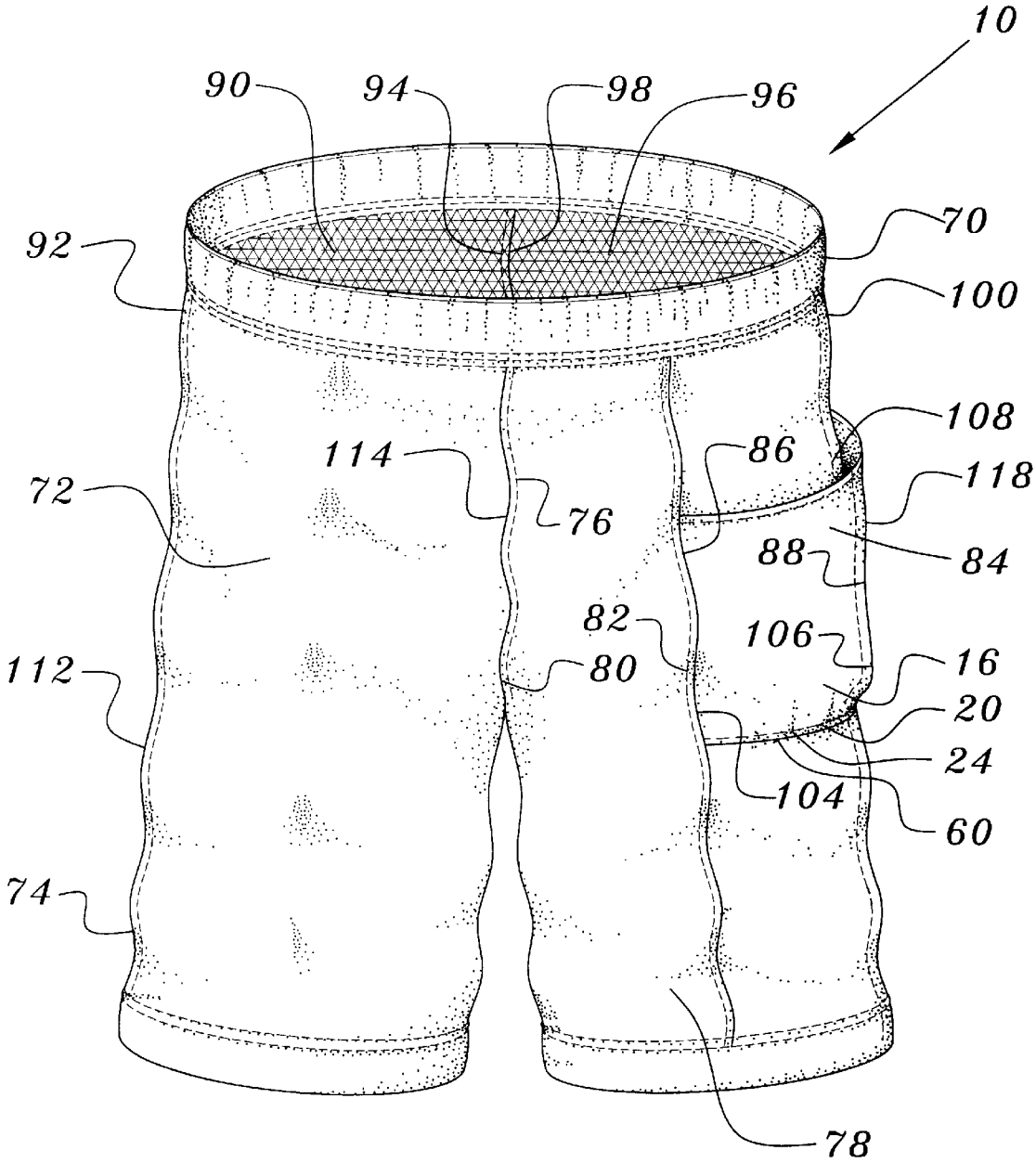
FIG. 4 is a front elevational view of a pair of shorts according to the present invention.

In yet another preferred embodiment of the present invention, the expandable pocket structure is attached to a pair of shorts 10. As best shown in FIG. 4, the shorts 10 have a waistband 70, a front left panel 72 which has a left edge portion 74 and a right edge portion 76 extending downwardly from the waistband 70, an inner front right panel 78 which has a left edge portion 80 and a right edge portion 82 extending downwardly from the waistband 70. An outer front right panel 84 which has a left edge portion 86 and a right edge portion 88 that extend downwardly from the waistband 70. A back left panel 90 with a left edge portion 92 and a right edge portion 94 that extend downwardly from the waistband 70. A back right panel 96 which has a left edge portion 98 and a right edge portion 100 that extend downwardly from the waistband 70.

There is at least one pocket 16 which has a left edge portion 104, a right edge portion 106, an upper end 108 and a lower end 60. An outer left seam 112 is provided along the left edge portion 74 of the front left panel 72 and along the left edge portion 92 of the back left panel 90. An inseam 114 is provided along the right edge portion 76 of the front left panel 72, along the left edge portion 80 of the inner front right panel 78, along the right edge portion 94 of the back left panel 90 and along the left edge portion 98 of the back right panel 96. An inner front right seem 116 is provided along the right edge portion 82 of the inner front right panel 78, along the left edge portion 86 of the outer front right panel 84 and along the left edge portion 104 of the pocket 16. An outer right seam 118 is provided along the right edge portion 88 of the outer front right panel 84, along the right edge portion 100 of the back right panel 96 and along the right edge portion 106 of the pocket 16.

In addition, the pocket 16 further has a transverse seam 20 positioned at the lower end 60 of the pocket 16 from the left edge portion 104 of the pocket 16 to the right edge portion 106 of the pocket 16 and from the left edge portion 86 of the outer front right panel 84 to the right edge portion 88 of the outer front right panel 84. The transverse seam 20 comprises an expandable stitch 24, whereby, the lower end 60 of the pocket 16 can expand in conjunction with the inner front right seam 116 and the outer right seam 118.

In a preferred embodiment, the pair of shorts 10 and the pocket 16 are both made from spandex or a similar stretchable material. When the pair of shorts 10 are stretched by the user, the pocket 16 will stretch in conjunction with the pair of shorts 10 since the outer edges (left edge portion 104 and right edge portion 106) of the pocket 16 are the integrally linked to the seams (inner front right seam 116 and the outer right seam 118) of the pair of shorts 10.

Figure 5:
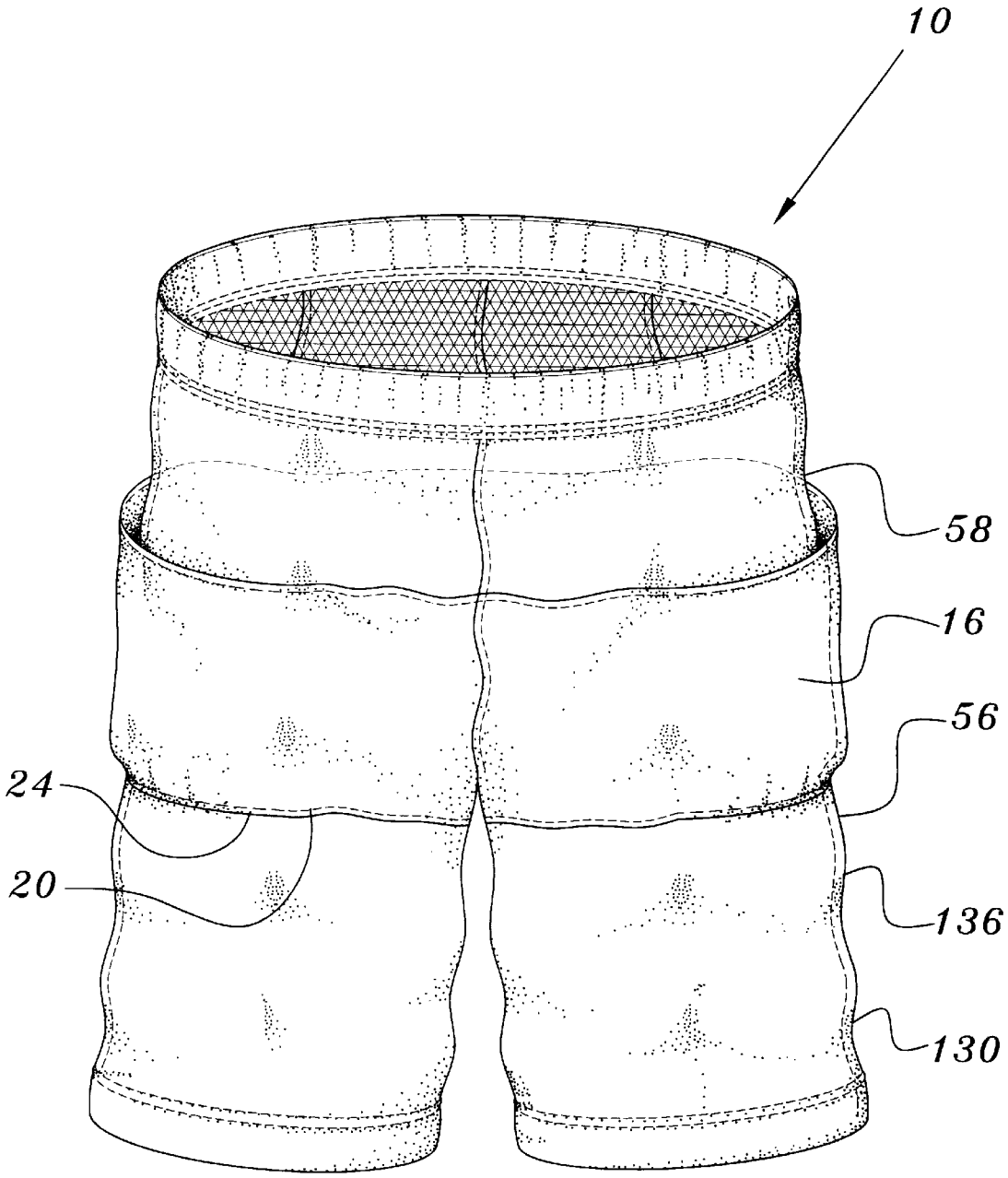
FIG. 5 is a front elevational view of the article of clothing according to the present invention.

As best shown in FIG. 5, another preferred embodiment of the present invention, the expandable pocket structure for an article of clothing 10 comprises at least one longitudinal seam 130 comprising a pocket 16 and a longitudinal seam 136 in the article of clothing 10. The ends 56, 58 of the pocket 16 comprise the longitudinal seam 130 of the article of clothing 10. In addition, the pocket 16 further has a transverse seam 20 along the pocket 16. The transverse seam 20 comprises an expandable stitch 24, whereby, the pocket 16 may expand as the ends 56, 58 of the pocket 16 and the longitudinal seam 130 of the article of clothing lo expand.

Figure 6:
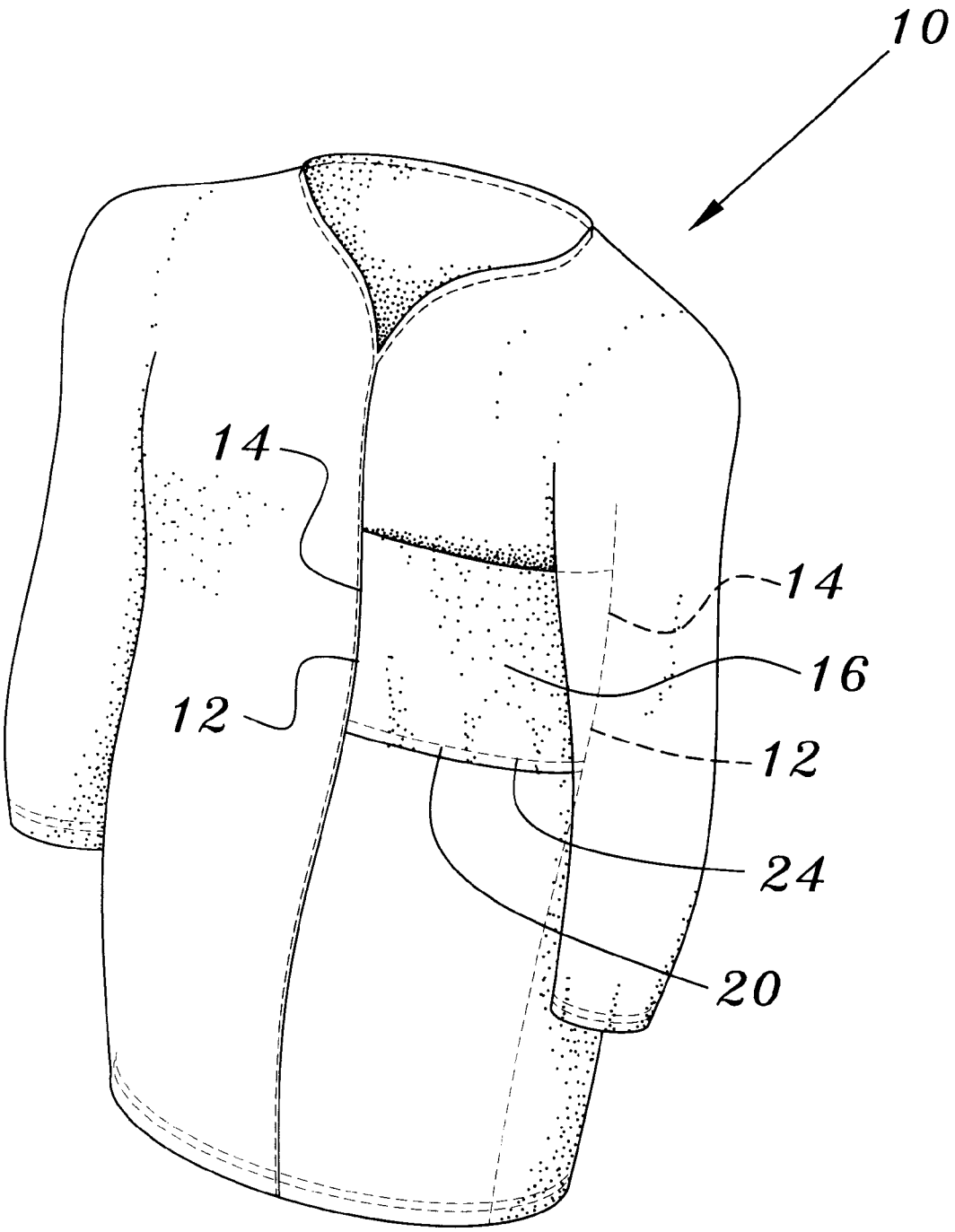
FIG. 6 is a front elevational view of a shirt, blouse, coat or jacket according to the present invention.

FIG. 6 shows a shirt 10, blouse 10, coat 10 or jacket 10 with a expandable pocket structure of the present invention. Specifically, pocket 16 comprises a pair of opposing seams 12 on the articles of clothing (shirt 10, blouse 10, coat 10 or jacket 10) where the opposing seams 14 of the pocket 16 attach and/or overlay the opposing seams 12 of the article of clothing (shirt 10, blouse 10, coat 10 or jacket 10).

In addition, the pocket 16 further has a transverse seam 20 positioned across the opposing seams 14 of the pocket 16 and the opposing seams 12 of the article of clothing (shirt 10, blouse 10, coat 10 or jacket 10). The transverse seam 20 comprises an expandable stitch 24, whereby, the pocket 16 may expand as the opposing seams 14 of the pocket 16 and the opposing seams 12 of the article of clothing (shirt 10, blouse 10, coat 10 or jacket 10) expand, thereby providing an expandable and durable pocket 16 for the article of clothing (shirt 10, blouse 10, coat 10 or jacket 10).

Figure 7:
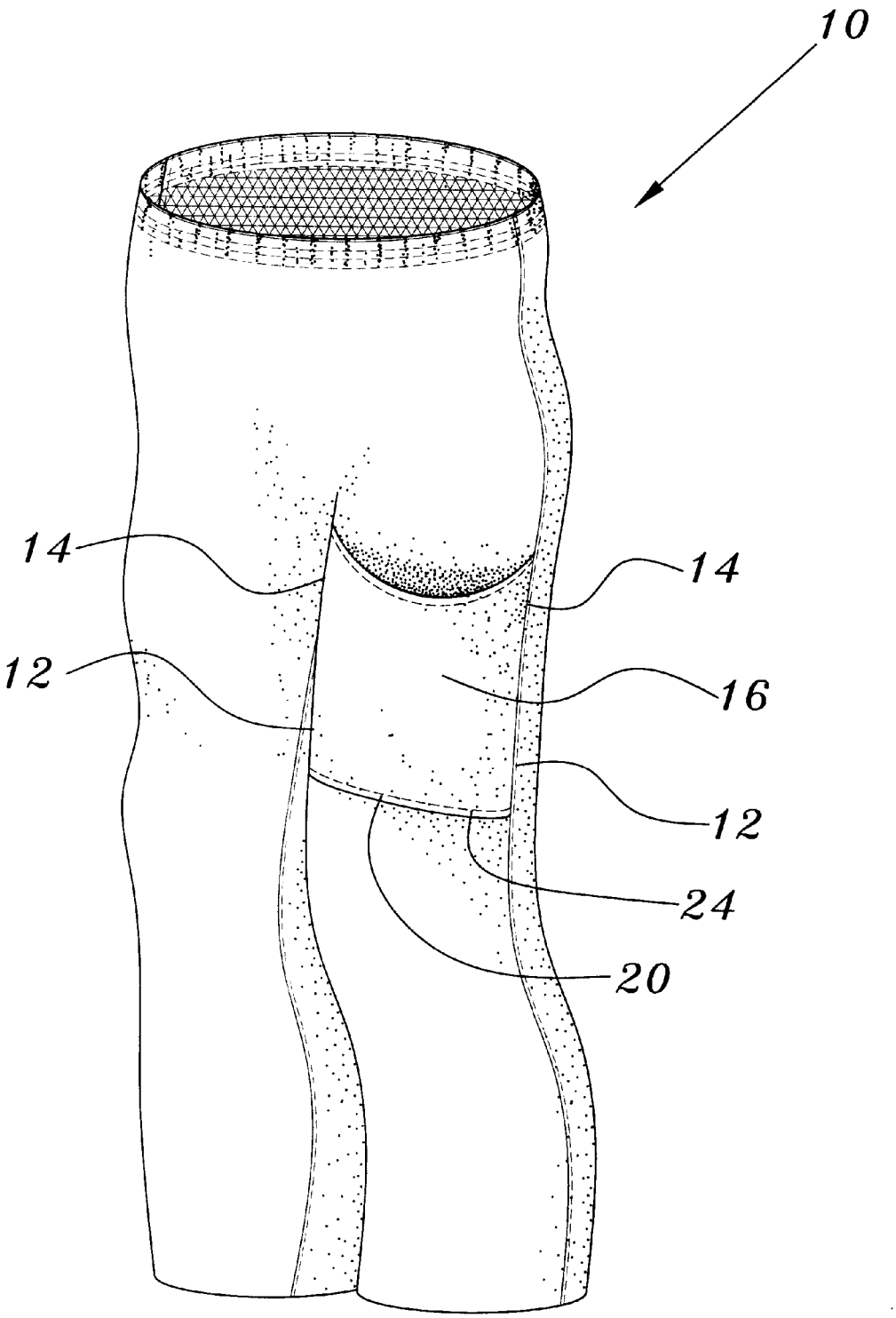
FIG. 7 is a front elevational view of a pair of pants according to the present invention.

FIG. 7 shows a pair of pants 10 with a expandable pocket structure of the present invention. Specifically, pocket 16 comprises a pair of opposing seams 12 on the pair of pants 10 where the opposing seams 14 of the pocket 16 attach and/or overlay the opposing seams 12 of the pair of pants 10.

In addition, the pocket 16 further has a transverse seam 20 positioned across the opposing seams 14 of the pocket 16 and the opposing seams 12 of the pair of pants 10. The transverse seam 20 comprises an expandable stitch 24, whereby, the pocket 16 may expand as the opposing seams 14 of the pocket 16 and the opposing seams 12 of the pair of pants 10 expand, thereby providing an expandable and durable pocket 16 for the pair of pants 10.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

I claim:

1. An article of clothing having opposing seams, comprising in combination:

a pocket having opposing seams, the opposing seams of said pocket comprising the opposing seams of the article of clothing; and said pocket further having a transverse seam positioned across the opposing seams of said pocket and the opposing seams of said article of clothing, said transverse seam comprising an expandable stitch, said expandable stitch is a serge stitch,whereby, said pocket may expand as said opposing seams of said pocket and said opposing seams of said article of clothing expand.

2. An article of clothing having opposing seams, comprising in combination:

a pocket having opposing seams, the opposing seams of said pocket comprising the opposing seams of the article of clothing; and said pocket further having a transverse seam positioned across the opposing seams of said pocket and the opposing seams of said article of clothing, said transverse seam comprising an expandable stitch, said pocket further comprises a pocket cover having a transverse seam positioned across the opposing seams of said article of clothing and the opposing seams of said pocket,whereby, said pocket may expand as said opposing seams of said pocket and said opposing seams of said article of clothing expand.

3. An article of clothing having longitudinal seams comprising in combination:

at least one front panel having a first end and a second end;

at least one back panel having a first end and a second end;

at least one pocket having a first end, a second end and a lower end;

a first longitudinal seam along said first end of said front panel, along said first end of said back panel and along said first end of said pocket;

a second longitudinal seam along said second end of said front panel, along said second end of said back panel and along said second end of said pocket; and said pocket further having a transverse seam at the lower end of said pocket positioned between said first longitudinal seam and said second longitudinal seam, said transverse seam comprising an expandable stitch, whereby, said lower end of said pocket can expand in conjunction with said first longitudinal seam and said second longitudinal seam.

4. The article of clothing according to claim 3, wherein the article of clothing is a pair of shorts.

5. The article of clothing according to claim 4, wherein the pair of shorts has an adjustable waistband.

6. The article of clothing according to claim 4, wherein the pair of shorts and the pocket are made of a stretchable material.

7. The article of clothing according to claim 3, wherein said pocket further comprises a pocket cover having a transverse seam positioned across said first longitudinal seam and said second longitudinal seam.

8. The article of clothing according to claim 3, wherein said expandable stitch is a serge stitch.

9. A pair of shorts having a plurality of seams comprising in combination:

a waistband;

a front left panel having a left edge portion and a right edge portion extending downwardly from said waistband;

an inner front right panel having a left edge portion and a right edge portion extending downwardly from said waistband;

an outer front right panel having a left edge portion and a right edge portion extending downwardly from said waistband;

a back left panel having a left edge portion and a right edge portion extending downwardly from said waistband;

a back right panel having a left edge portion and a right edge portion extending downwardly from said waistband;

at least one pocket having a left edge portion, a right edge portion, an upper end and a lower end;

an outer left seam along said left edge portion of said front left panel and along said left edge portion of said back left panel;

an inseam along said right edge portion of said front left panel, along said left edge portion of said inner front right panel, along said right edge portion of said back left panel and along said left edge portion of said back right panel;

an inner front right seem along said right edge portion of said inner front right panel, along said left edge portion of said outer front right panel and along said left edge portion of said pocket;

an outer right seam along said right edge portion of said outer front right panel, along said right edge portion of said back right panel and along said right edge portion of said pocket; and said pocket further having a transverse seam positioned at the lower end of said pocket from said left edge portion of said pocket to said right edge portion of said pocket and from said left edge portion of said outer front right panel to said right edge portion of said outer front right panel, said transverse seam comprising an expandable stitch, whereby, said lower end of said pocket can expand in conjunction with said inner front right seam and said outer right seam.

10. The pair of shorts according to claim 9, wherein said waistband is adjustable.

11. The pair of shorts according to claim 9, wherein the pair of shorts and pocket are made of a stretchable material.

12. The pair of shorts according to claim 9, wherein said pocket further comprises a cover having a transverse seam positioned across said upper end of said pocket and opposing seams comprising said inner front right seam and said outer right seam of said shorts.

13. The pair of shorts according to claim 9, wherein said expandable stitch is a serge stitch.

* * * * *